US006027432A

United States Patent [19]

Cheng

[11] Patent Number: 6,027,432

[45] Date of Patent: Feb. 22, 2000

[54] EXERCISE BICYCLE

[76] Inventor: Chau Yang Cheng, No. 456, Pu Zi Street, Feng Yuan City, Taichung Hsien, Taiwan

[21] Appl. No.: 09/039,483

[22] Filed: Mar. 16, 1998

[51] Int. Cl.[7] ..... A63B 21/00

[52] U.S. Cl. ..... 482/57; 482/51; 601/30; 601/36; 601/23; 601/49; 601/67; 601/97; 601/98

[58] Field of Search ..... 482/57, 72, 908, 482/142, 51; 601/23, 24, 27, 30, 32, 36, 46, 49, 51, 67, 69, 70, 97, 98, 101

[56] References Cited

U.S. PATENT DOCUMENTS

| | | | |
|---|---|---|---|
| 3,140,711 | 7/1964 | McGathey | 601/49 |
| 4,003,375 | 1/1977 | Simjian | 128/54 |
| 4,958,831 | 9/1990 | Kim | 272/73 |
| 5,716,331 | 2/1998 | Chang | 601/50 |
| 5,722,916 | 3/1998 | Goldberg | 482/57 |

*Primary Examiner*—Danton D. DeMille
*Assistant Examiner*—Tam Nguyen
*Attorney, Agent, or Firm*—Browdy and Neimark

[57] ABSTRACT

An exercise bicycle is composed of a base, a motor, a seat plate, a plurality of resilient elements, a support unit, a seat, a handle, two pedals, and a drive device. The motor is mounted on the base and provided with an eccentric rod fastened with a shaft of the motor such that the eccentric rod is capable of disturbing the seat plate to vibrate horizontally at the time when the motor is in operation. The horizontal vibration of the seat plate is imparted via the support unit to the seat, the handle and the pedals for massaging the hips, the back, and the hands of a user of the exercise bicycle, who is engaged in a leg exercise.

4 Claims, 1 Drawing Sheet

EXERCISE BICYCLE

FIELD OF THE INVENTION

The present invention relates generally to an exercise device, and more particularly to an exercise bicycle.

BACKGROUND OF THE INVENTION

Conventional exercise bicycles are generally limited in purpose and designed for use by those who are fond of sports. Such conventional exercise bicycles are therefore not suitable for use by the retired population or those recuperating after an illness.

SUMMARY OF THE INVENTION

The primary objective of the present invention is to provide an exercise bicycle capable of exercising all parts of a human body. The exercise bicycle is intended for use by a retired person or a person recuperating after an illness.

In keeping with the principle of the present invention, the foregoing objective of the present invention is attained by an exercise bicycle consisting of a base, a motor, a seat plate, a plurality of resilient elements, a support unit, a seat, a handle, two pedals, and a drive device. The motor is mounted on the base and provided with an eccentric rod for generating the horizontal vibration of the seat plate in conjunction with the resilient elements when the motor is in operation. When a user of the exercise bicycle pedals, the horizontal vibration is imparted to the seat, the handle and the pedals for massaging the hips, the back, the hands and the legs of the user.

The features and functions of the present invention will be more readily understood upon a thoughtful deliberation of the following detailed description of a preferred embodiment of the present invention with reference to the accompanying drawing.

DETAILED DESCRIPTION OF THE INVENTION

Figure 1:
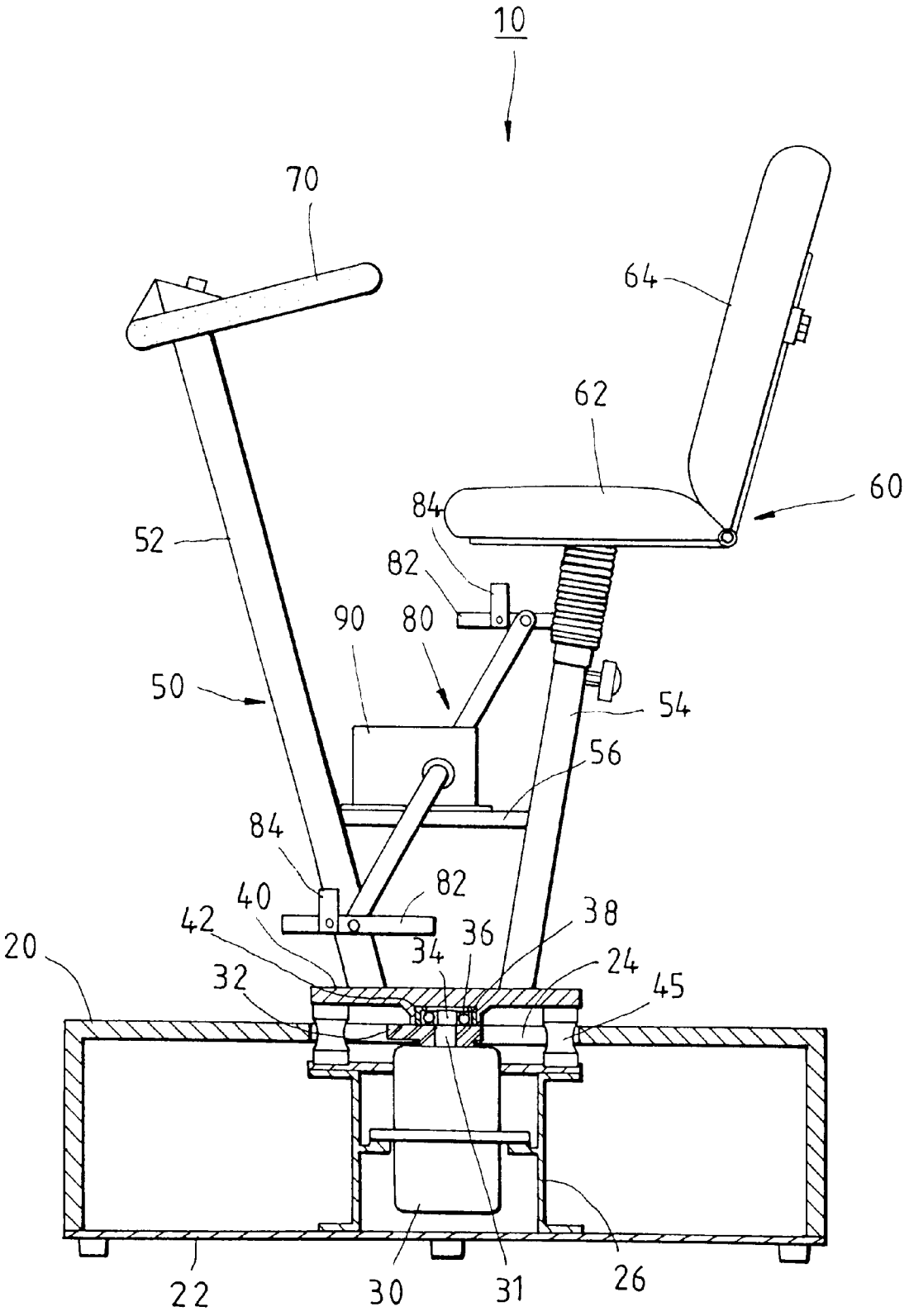
FIG. 1 shows a side schematic view of the present invention.

As shown in FIG. 1, an exercise bicycle 10 embodied in the present invention is composed of the component parts described hereinafter.

A base 20 of a rectangular boxlike construction is composed of a bottom plate 22 of an iron material for securing the base 20. The base 20 is provided in the upper long side thereof with an opening 24, and in the bottom thereof with a fastening frame 26 corresponding in location to the opening.

A motor 30 has a shaft 31 which is fastened with the fastening frame 26 such that the motor 30 is contained in the boxlike base 20. The shaft 31 of the motor 30 is fastened with an inertia fly wheel 32 for increasing the centrifugal torsion. The shaft 31 is provided at the top end thereof with an eccentric rod 34 having an outer diameter smaller than that of the shaft 31. The eccentric rod 34 is provided with a bearing 36 and a sleeve 38.

A base plate 40 is provided in the underside thereof with a round cavity 42 for engaging pivotally the sleeve 38 of the eccentric rod 34 of the motor 30.

A plurality of resilient elements 45 of a columnar construction are made of a plastic material and are fastened respectively at the top end thereof with the periphery of the underside of the base plate 40, and at the bottom end thereof with the fastening frame 26. The resilient elements 45 are intended for supporting and confining the base plate 40 such that the seat plate 40 is not caused to rotate along with the motor 30 in operation, and that the seat plate 40 is disturbed by the eccentric rod 34 to engage in the horizontal vibration.

A support unit 50 consists of a front rod 52, a rear rod 54, and a cross rod 56. The front rod 52 and the rear rod 54 are fastened respectively at the bottom end thereof with the seat plate 40 by welding such that the front rod 52 and rear rod 54 form respectively a predetermined angle with the seat plate 40. The cross rod 56 are fastened at both ends thereof with the front rod 52 and the rear rod 54 by welding such that the cross rod 56 is held at a predetermined height level of the front rod 52 and the rear rod 54.

A seat 60 is adjustably mounted on the top end of the rear rod 54 and is provided with a seat pad 62 and a backrest 64.

A handle 70 is fastened with the top end of the front rod 52.

A pedal unit 80 is mounted on the cross rod 56 and is composed of two pedals 82 each having a foot strap 84 for securing the foot of a person seated on the seat 60.

A drive device 90 is composed of a motor for driving the pedal unit 80 such that both feet of the person seated on the seat 60 are actuated to engage in the pedaling exercise. The speed of the drive device 90 can be so adjusted that the speed of motion of the pedal unit 80 can be regulated. The transmission of force from the drive device 90 to the pedal unit 80 may be attained by means of a transmission belt or a sanding wheel for providing a resisting force capable of preventing the pedal unit 80 from being driven by the drive device 90 at such time when the speed of the leg pedaling motion of the exerciser can not keep up with the speed of the pedal unit 80. In addition to the leg exercise, the exercise bicycle is capable of massaging the hips, the back, and the hands of the exerciser at the same time when the exerciser is doing the leg exercise. The massaging effect is brought about by the high frequency vibration generated by the seat plate 40 and imparted to the seat 60, the handle 70 and the pedal unit 80 via the support unit 50.

The embodiment of the present invention described above is to be deemed in all respects as being merely illustrative and not restrictive. Accordingly, the present invention may be embodied in other specific forms without deviating from the spirit thereof. The present invention is therefore to be limited only by the scope of the following appended claim.

What is claimed is:

1. An exercise bicycle comprising:

a base provided with a fastening frame fastened therewith;

a motor mounted on said fastening frame of said base such that a shaft of said motor faces upward;

an eccentric rod fastened with a free end of said shaft of said motor;

a seat plate fastened pivotally with said eccentric rod;

a plurality of resilient elements fastened respectively at one end thereof with said seat plate, and at another end thereof with said fastening frame of said base, such that said seat plate is disturbed by said eccentric rod to vibrate horizontally at such time when said motor is in operation;

a support unit composed of a front rod, a rear rod, and a cross rod, said front rod and said rear rod being fastened with said seat plate, said cross rod being fastened with said front rod and said rear rod;

a seat mounted adjustably on one end of said rear rod of said support unit such that a horizontal vibration of said seat plate is imparted to said seat via said support unit at such time when said motor is in operation;

a handle fastened with one end of said front rod of said support unit such that a horizontal vibration of said seat plate is imparted to said handle via said support unit at such time when said motor is in operation;

two pedals fastened pivotally with said cross rod of said support unit such that a horizontal vibration of said seat plate is imparted to said two pedals via said support unit at such time when said motor is in operation; and a motorized drive device mounted on said cross rod of said support unit, said motorized drive device being adjustable to drive said two pedals at a selected speed.

2. The exercise bicycle according to claim 1, wherein said motorized drive device has a transmission means which slows the speed of said two pedals to a speed of a user's pedaling.

3. The exercise bicycle according to claim 2, wherein the transmission means is a transmission belt.

4. The exercise bicycle according to claim 2, wherein the transmission means is a sanding wheel.

* * * * *